US011635050B2

(12) United States Patent
Oosawa

(10) Patent No.: US 11,635,050 B2
(45) Date of Patent: Apr. 25, 2023

(54) INTAKE MANIFOLD AND OUTBOARD MOTOR

(71) Applicant: MIKUNI CORPORATION, Tokyo (JP)

(72) Inventor: Hirobumi Oosawa, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 17/383,386

(22) Filed: Jul. 22, 2021

(65) Prior Publication Data

US 2022/0099056 A1 Mar. 31, 2022

(30) Foreign Application Priority Data

Sep. 26, 2020 (JP) ..... JP2020-161543

(51) Int. Cl.
*F02M 35/10* (2006.01)
*F02B 61/04* (2006.01)
*F02M 35/104* (2006.01)

(52) U.S. Cl.
CPC ..... *F02M 35/1015* (2013.01); *F02B 61/045* (2013.01); *F02M 35/104* (2013.01); *F02M 35/10236* (2013.01)

(58) Field of Classification Search
CPC ..... F02M 35/1015; F02M 35/10236; F02M 35/104; F02B 61/045
See application file for complete search history.

(56) References Cited

U.S. PATENT DOCUMENTS 7,464,682 B2 * 12/2008 Park ..... F02B 27/0284 123/184.55
11,067,043 B2 * 7/2021 Itagaki ..... F02M 26/41
2005/0016487 A1 * 1/2005 Ikuma ..... F02M 35/1036 123/184.56
2008/0072863 A1 * 3/2008 Egawa ..... F02M 35/10288 123/184.57
2010/0288247 A1 * 11/2010 Tanikawa ..... F02M 35/112 123/184.61
2015/0047595 A1 * 2/2015 Oiwa ..... F02M 35/104 123/184.55

(Continued)

FOREIGN PATENT DOCUMENTS

JP 2012229646 11/2012
JP 2015000676 1/2015

(Continued)

*Primary Examiner* — Kurt Philip Liethen
(74) *Attorney, Agent, or Firm* — JCIPRNET

(57) ABSTRACT

An intake manifold which can ensure a pressure resistance strength, a mechanical strength, and the like and also reduce a passage resistance and an outboard motor which can be made smaller and thinner in a width direction. A resinous intake manifold made of a resin and configured to be applied to an engine of an outboard motor includes: a surge tank which forms a flat contour and includes an intake inlet; and a plurality of branch pipes which defines intake passages communicating with an internal space of the surge tank, wherein a contour wall of the surge tank includes a plurality of ridge portions which protrudes toward the internal space and is oriented toward the intake passage side.

13 Claims, 15 Drawing Sheets

(56) References Cited

U.S. PATENT DOCUMENTS

| | | | | |
|---|---|---|---|---|
| 2016/0061167 | A1* | 3/2016 | Senda | F02M 35/104<br>123/184.21 |
| 2016/0153409 | A1* | 6/2016 | Sudo | F02M 35/104<br>123/184.61 |
| 2017/0167452 | A1* | 6/2017 | Tachikawa | F02M 35/10229 |
| 2021/0123398 | A1* | 4/2021 | Sakurai | F02M 35/10295 |

FOREIGN PATENT DOCUMENTS

| | | | |
|---|---|---|---|
| JP | 2017066985 | A * | 4/2017 |
| JP | 2020026150 | | 2/2020 |

* cited by examiner

INTAKE MANIFOLD AND OUTBOARD MOTOR

CROSS-REFERENCE TO RELATED APPLICATION

This application claims the priority benefit of Japan application serial no. 2020-161543, filed on Sep. 26, 2020. The entirety of the above-mentioned patent application is hereby incorporated by reference herein and made a part of this specification.

BACKGROUND

Technical Field

The disclosure relates to a resinous intake manifold which is applied to, for example, an intake system of an engine of an outboard motor or the like and particularly to an intake manifold provided with a flat surge tank and an outboard motor equipped with the intake manifold.

Description of Related Art

As a conventional outboard motor, there is known an outboard motor which includes an engine, a body, a propeller, a hull attachment portion, an engine cover, and the like and in which the engine includes an intake system provided with an intake manifold, a throttle body, and a resonator (for example, Patent Document 1: Japanese Patent Application Laid-Open No. 2012-229646).

Further, as another outboard motor, there is known an outboard motor which includes an engine, an engine holder, a drive shaft housing, a propeller, a hull attachment bracket device, an engine cover, and the like and in which the engine includes an intake system provided with an outer air duct, a silencer, a throttle body and an intake manifold, and a heat shield member disposed between the intake manifold and an engine body (for example, Patent Document 2: Japanese Patent Application Laid-Open No. 2015-676).

Further, as still another outboard motor, there is known an outboard motor which includes an engine, an engine holder, a drive shaft housing, a propeller, a hull attachment bracket device, an engine cover, a shifting electric actuator, and the like and in which the engine includes an intake system provided with a silencer box, a surge tank, a throttle body, and an intake manifold (for example, Patent Document 3: Japanese Patent Application Laid-Open No. 2020-26150).

In the conventional outboard motor, the intake manifold includes a surge tank which defines a predetermined volume and to which the throttle body is attached and a plurality of branch pipes which extends from the surge tank and defines an intake passage communicating with an intake port of the engine.

Then, the intake manifold is oriented so that the plurality of branch pipes is arranged in the vertical direction, is fixed to the engine, and is covered with the engine cover from the outside.

Incidentally, when the width of the outboard motor is made narrower for miniaturization, the surge tank of the intake manifold covered with the engine cover needs to be thinner in the width direction of the outboard motor. That is, the surge tank needs to be flat.

However, when the surge tank is simply formed to be flat, there is concern that the mechanical strength of the flat contour wall forming the surge tank decreases, and the pressure resistance strength decreases. Further, there is concern that the passage resistance increases when an intake air having flowed into the surge tank flows through each branch pipe, and the intake air is not uniformly flow into each branch pipe.

The disclosure has been made in view of the above-described circumstances and provides an intake manifold which can ensure a pressure resistance strength, a mechanical strength, and the like and also reduce a passage resistance and an outboard motor which can be made smaller and thinner in a width direction.

SUMMARY

An intake manifold of the disclosure is an intake manifold made of a resin and configured to be applied to an engine, including: a surge tank which forms a flat contour and includes an intake inlet; and a plurality of branch pipes which defines an intake passage communicating with an internal space of the surge tank, wherein a contour wall defines the surge tank includes a plurality of ridge portions which protrudes toward the internal space and is oriented toward the intake passage.

DESCRIPTION OF THE EMBODIMENTS

Figure 1:
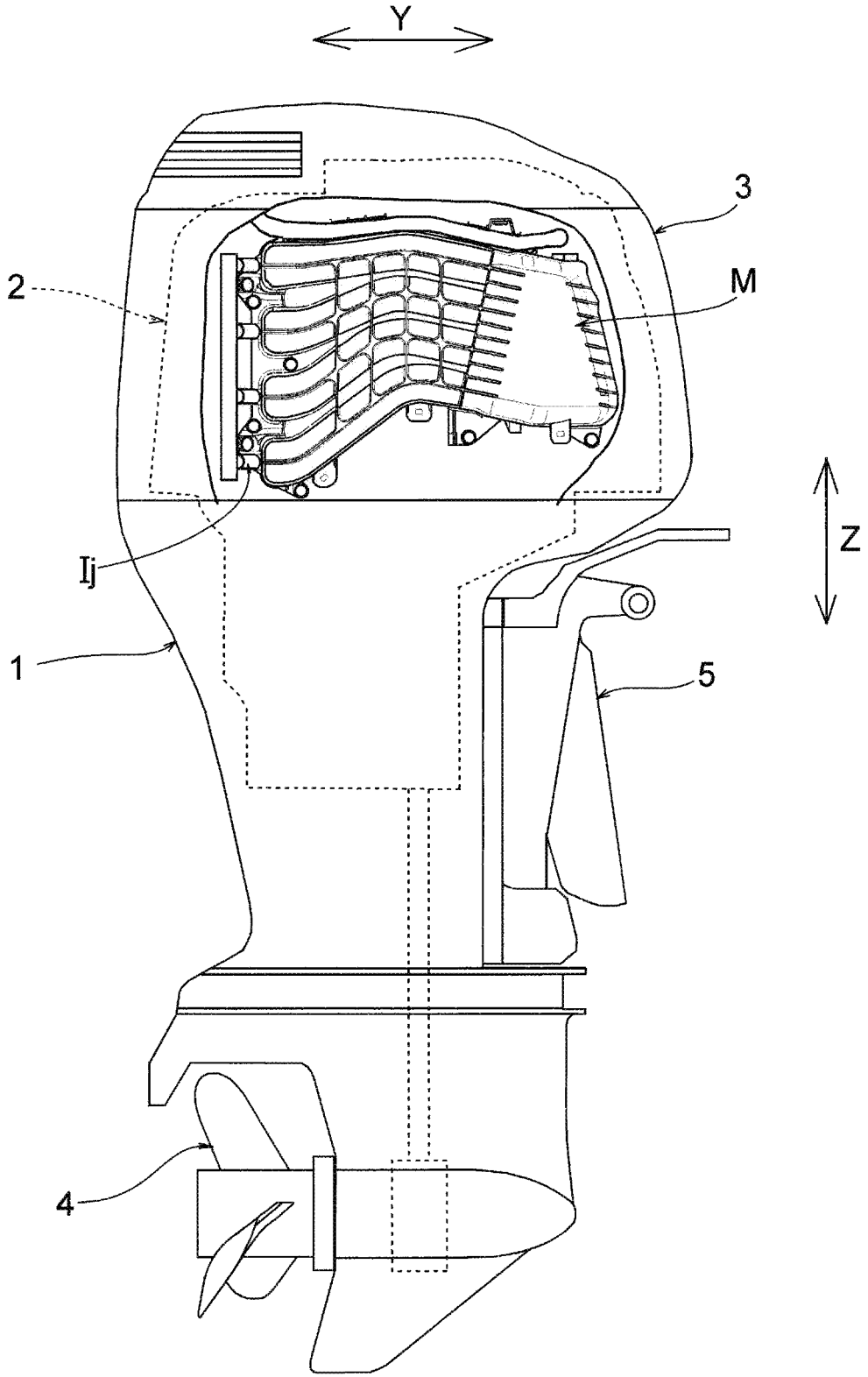
FIG. 1 is a view showing an outboard motor equipped with an engine including an intake manifold of the disclosure and is a side view when viewed from a horizontal direction after an engine cover is partially cut.

An intake manifold of the disclosure is an intake manifold made of a resin and configured to be applied to an engine, including: a surge tank which forms a flat contour and includes an intake inlet; and a plurality of branch pipes which defines an intake passage communicating with an internal space of the surge tank, wherein a contour wall defines the surge tank includes a plurality of ridge portions which protrudes toward the internal space and is oriented toward the intake passage.

In the intake manifold, the plurality of ridge portions may have a cross-section in which a root area with an inner wall surface of the contour wall is curved in a concave shape and a protruding tip area is curved in a convex shape.

In the intake manifold, the contour wall of the surge tank may include a first extension wall which extends along a plane direction in which the plurality of branch pipes is arranged, a second extension wall which faces the first extension wall, and an outer peripheral wall which connects and closes outer edge areas of the first extension wall and the second extension wall, the first extension wall may be provided with the plurality of ridge portions, and the second extension wall may be provided with the intake inlet.

The intake manifold may further include a plurality of branch walls which branches the plurality of branch pipes from the surge tank and the plurality of ridge portions may be arranged to respectively correspond to the plurality of branch walls.

In the intake manifold, the plurality of ridge portions and the plurality of branch walls may be formed to face each other with a predetermined gap therebetween.

In the intake manifold, the plurality of ridge portions may include a proximity ridge portion which is disposed in an area close to the intake inlet, and the gap between the proximity ridge portion and the branch wall may be set to be larger than the gap between the branch wall and the other ridge portion except for the proximity ridge portion among the plurality of ridge portions.

In the intake manifold, the ridge portions may be formed to extend linearly toward the branch walls, correspondingly.

In the intake manifold, the ridge portions may be formed to extend as being curved streamlinely from the intake inlet toward the branch walls, correspondingly.

In the intake manifold, an outer wall surface of the contour wall provided with the plurality of ridge portions may be formed to be flat.

In the intake manifold, an outer wall surface of the contour wall provided with the plurality of ridge portions may be formed to be recessed in a groove shape.

In the intake manifold, the intake manifold may be formed by vibration-welding a first resin molded body defining a half body of the surge tank and half bodies of the branch pipes and a second resin molded body defining a half body of the surge tank and half bodies of the branch pipes.

In the intake manifold, the first resin molded body may include a first extension wall which extends along a plane direction in which the plurality of branch pipes is arranged, the plurality of ridge portions which is provided in the first extension wall, and a first welded portion which has an annular shape, and the second resin molded body may include a second extension wall which faces the first extension wall, the intake inlet which is provided in the second extension wall, and a second welded portion which is welded to the first welded portion and has an annular shape.

An outboard motor of the disclosure is an outboard motor including: an engine which includes an intake manifold; a body which holds the engine; a propeller which is rotated by driving power of the engine; and an engine cover which covers the engine and the intake manifold is the intake manifold having any of the above-described configurations.

According to the intake manifold with the above-described configuration, the intake manifold can be made smaller and thinner, can ensure a pressure resistance strength, a mechanical strength, and the like, and can also reduce a passage resistance. Further, according to the outboard motor with the above-described configuration, the outboard motor can be made smaller and thinner in the width direction.

Hereinafter, an embodiment of the disclosure will be described with reference to the accompanying drawings.

An intake manifold according to the disclosure is made of a resin material and is disposed between a cylinder head of an engine body and a throttle body located on the downstream side of an intake duct in an intake system of an engine. Here, a case in which the intake manifold is applied to an engine of an outboard motor will be described as an embodiment.

Figure 2:
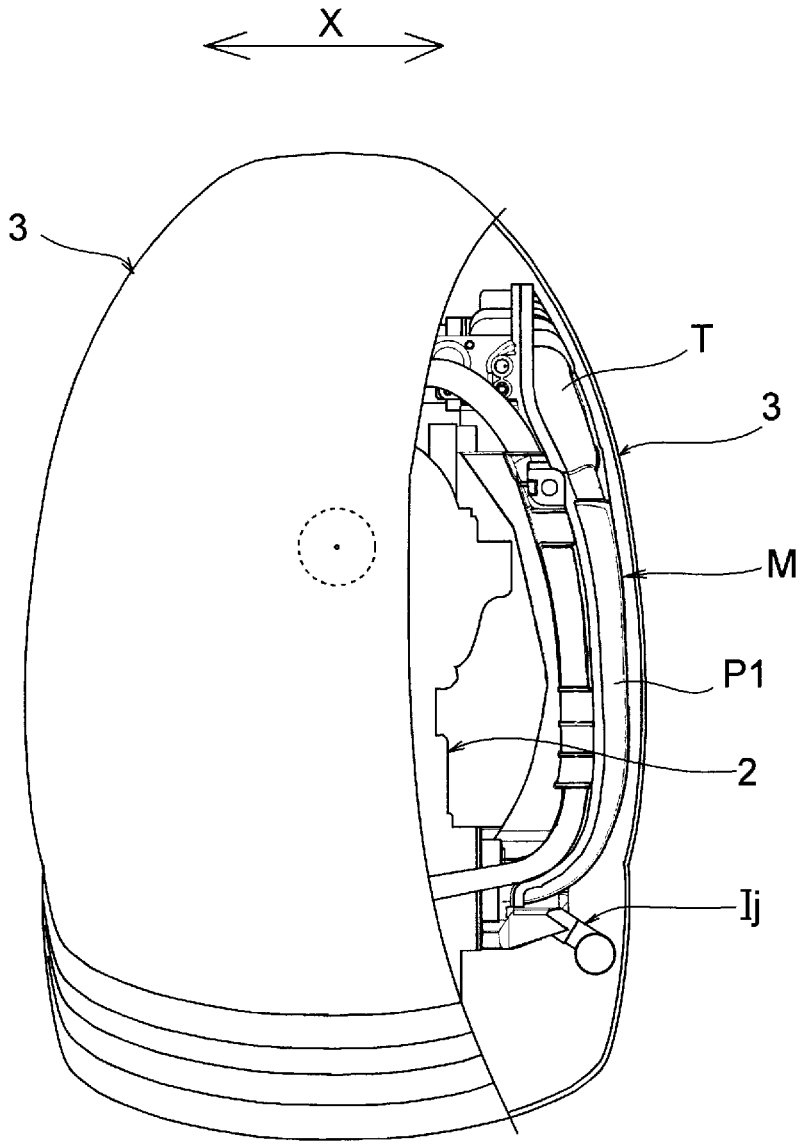
FIG. 2 is a view showing the outboard motor equipped with the engine including the intake manifold of the disclosure and is a plan view when viewed from above in a vertical direction after the engine cover is partially cut.

The outboard motor is attached to a rear part of a hull to generate propulsion and includes, as shown in FIGS. 1 and 2, a body 1, an engine 2 fixed to the body 1, an engine cover 3 covering the engine 2, a propeller 4 disposed below the body 1, a bracket 5 used for attachment to the hull, a power transmission system disposed in the body 1 and transmitting power of the engine 2 to the propeller 4, and a fuel tank.

Here, for convenience of description, the upright direction in which the outboard motor is attached to the hull is referred to as a vertical direction Z, the width direction of the outboard motor is referred to as a horizontal direction X, and the front and rear direction in which propulsion is generated is referred to as a horizontal direction Y.

The engine 2 is a multi-cylinder engine, here, an in-line four-cylinder internal combustion engine and includes an engine body having a cylinder block, a cylinder head, an oil pan, and the like and an intake system and an exhaust system attached to the engine body.

The intake system includes an outside air intake duct, a throttle body, and an intake manifold M. In addition, the intake system may include a resonator and a silencer if necessary.

Figure 3:
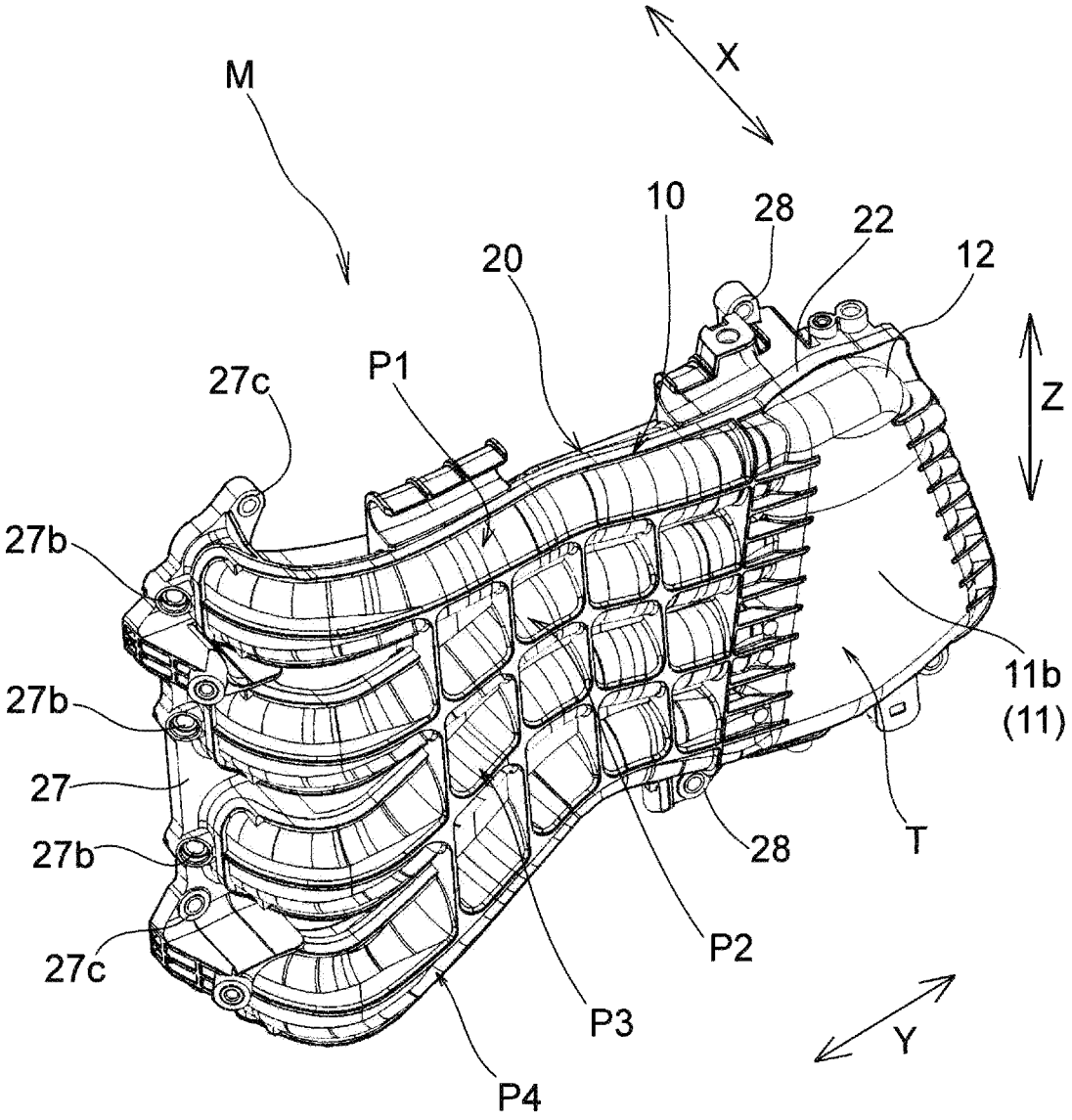
FIG. 3 is a view showing the intake manifold of the disclosure and is an external perspective view when the outside adjacent to the engine cover is viewed obliquely while the intake manifold is attached to an engine body.
Figure 4:
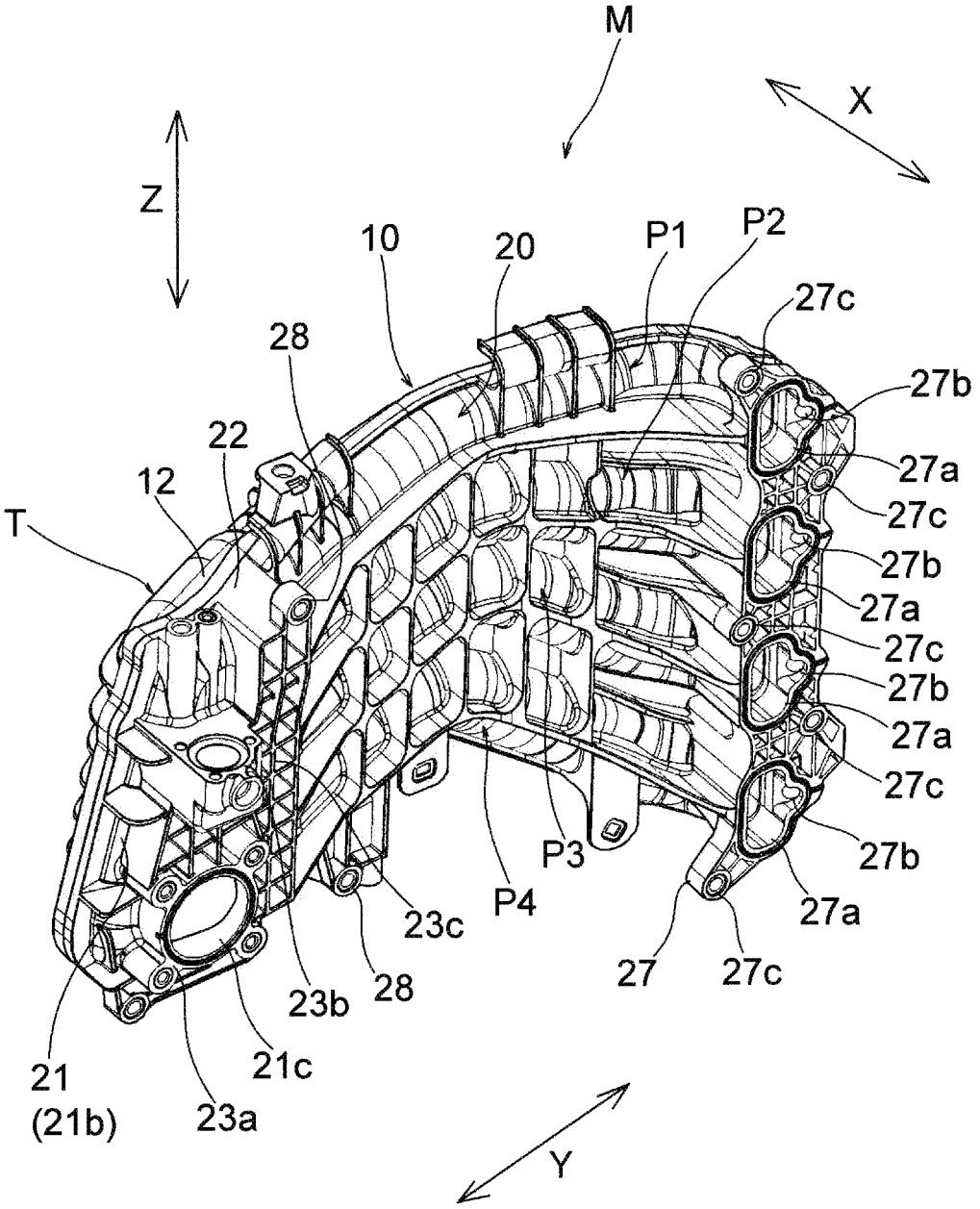
FIG. 4 is a view showing the intake manifold of the disclosure and is an external perspective view when the inside adjacent to the engine body is viewed obliquely while the intake manifold is attached to the engine body.

As shown in FIGS. 3 and 4, the intake manifold M according to the embodiment is formed such that a first resin molded body 10 and a second resin molded body 20 are integrally joined by vibration-welding to define a surge tank T and a plurality of (here, four) branch pipes P1, P2, P3, and P4.

The surge tank T defines an internal space S and the branch pipes P1, P2, P3, and P4 respectively define intake passages p1, p2, p3, and p4.

As shown in FIG. 1, the intake manifold M is oriented so that the plurality of branch pipes P1 to P4 is arranged in the vertical direction Z while being attached to the engine 2.

Since the surge tank T of the intake manifold M is disposed adjacent to the engine cover 3 in the width direction (the horizontal direction X) of the outboard motor as shown in FIG. 2, the surge tank is formed to form a flat contour which extends in the vertical direction Z, that is, which extends in the plane direction in which four branch pipes P1 to P4 are arranged.

The first resin molded body 10 is previously molded by a mold using a thermoplastic resin material and includes, as shown in FIGS. 3 to 6, a first extension wall 11 and an outer peripheral wall 12 which are contour walls defining a half body of the surge tank T, a plurality of (here, three) ridge portions 13*a*, 13*b*, and 13*c* which is provided in an inner wall surface 11*a* of the first extension wall 11, four passage walls 14*a*, 14*b*, 14*c*, and 14*d* which define half bodies of the branch pipes P1 to P4, a plurality of (here, three) branch walls 15*a*, 15*b*, and 15*c* which respectively extends from the branch points of four passage walls 14*a* to 14*d*, and a first welded portion 16 which has an annular shape.

The second resin molded body 20 is previously molded by a mold using a thermoplastic resin material and includes, as shown in FIGS. 3 to 6, a second extension wall 21 and an outer peripheral wall 22 which are contour walls defining a half body of the surge tank T, an intake inlet 21*c* which is provided in the second extension wall 21, flange portions 23*a* and 23*b* which are provided in the outer wall surface 21*b* of the second extension wall 21, four passage walls 24*a*, 24*b*, 24*c*, and 24*d* which define half bodies of the branch pipes P1 to P4, a plurality of (here, three) branch walls 25*a*, 25*b*, and 25*c* which respectively extends from the branch points of four passage walls 24*a* to 24*d*, a second welded portion 26 which has an annular shape, a flange portion 27 which is attached to the engine body, and a plurality of boss portions 28 which is fixed to the engine body by screws.

The first extension wall 11 is formed to extend in the plane direction (XZ plane direction) in which four branch pipes P1 to P4 are arranged and includes the inner wall surface 11*a* which defines the internal space S of the surge tank T and the outer wall surface 11*b* which is disposed adjacent to the engine cover 3 toward the outside of the outboard motor.

Figure 6:
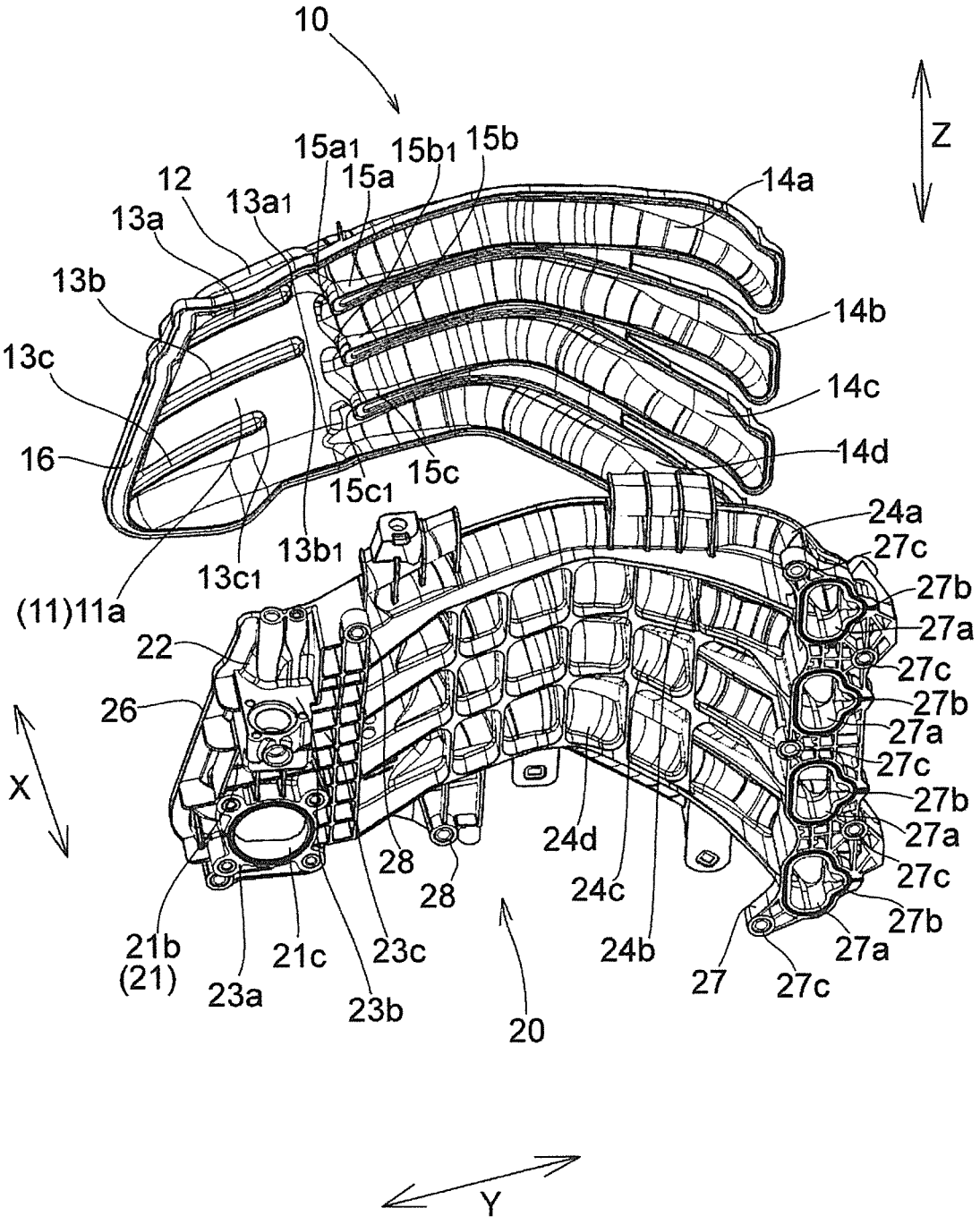
FIG. 6 is an exploded perspective view when the first resin molded body and the second resin molded body constituting the intake manifold of the disclosure are disassembled and viewed from the inside obliquely.
Figure 7:
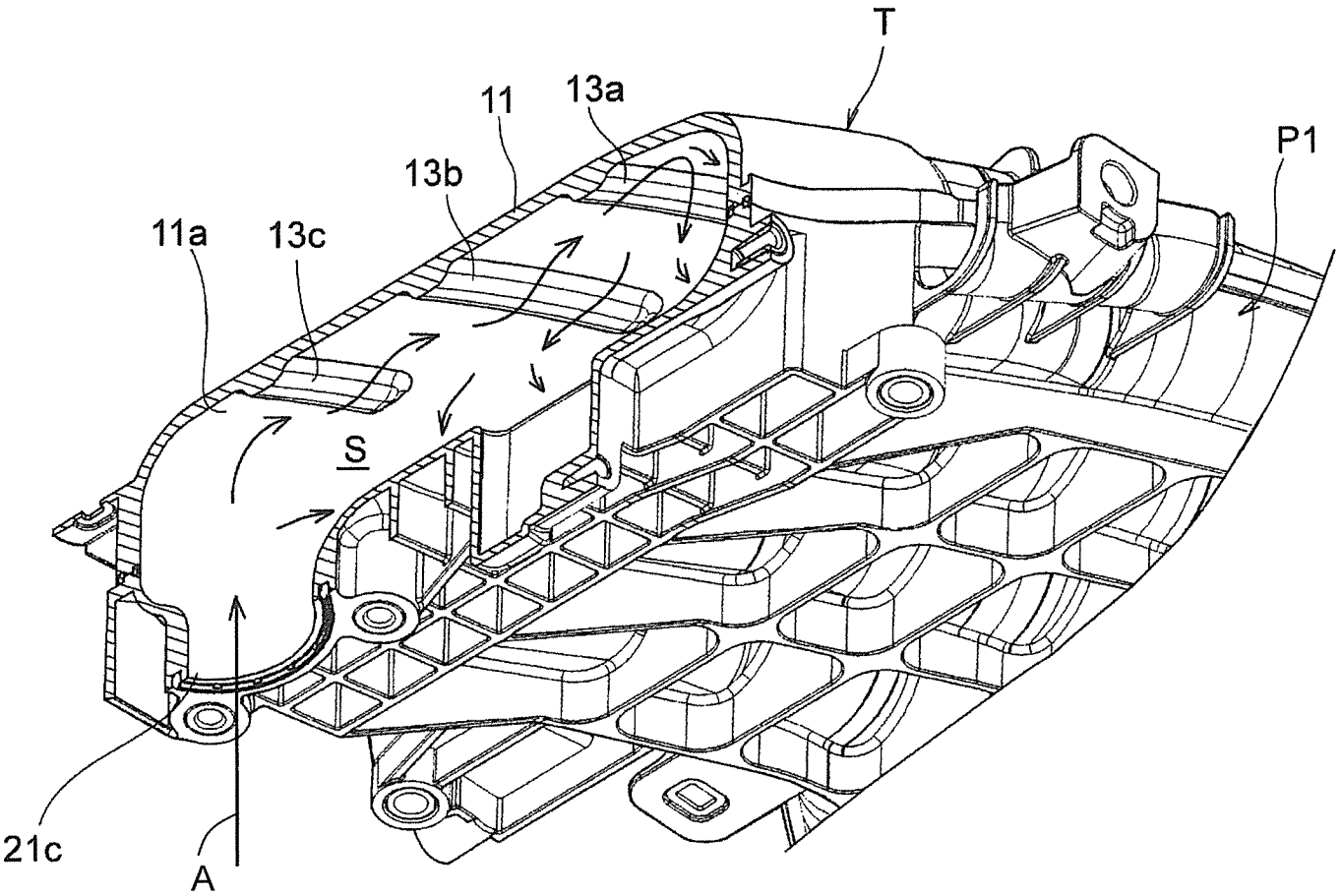
FIG. 7 is a perspective cross-sectional view when a surge tank of the intake manifold of the disclosure is partially cut.
Figure 8:
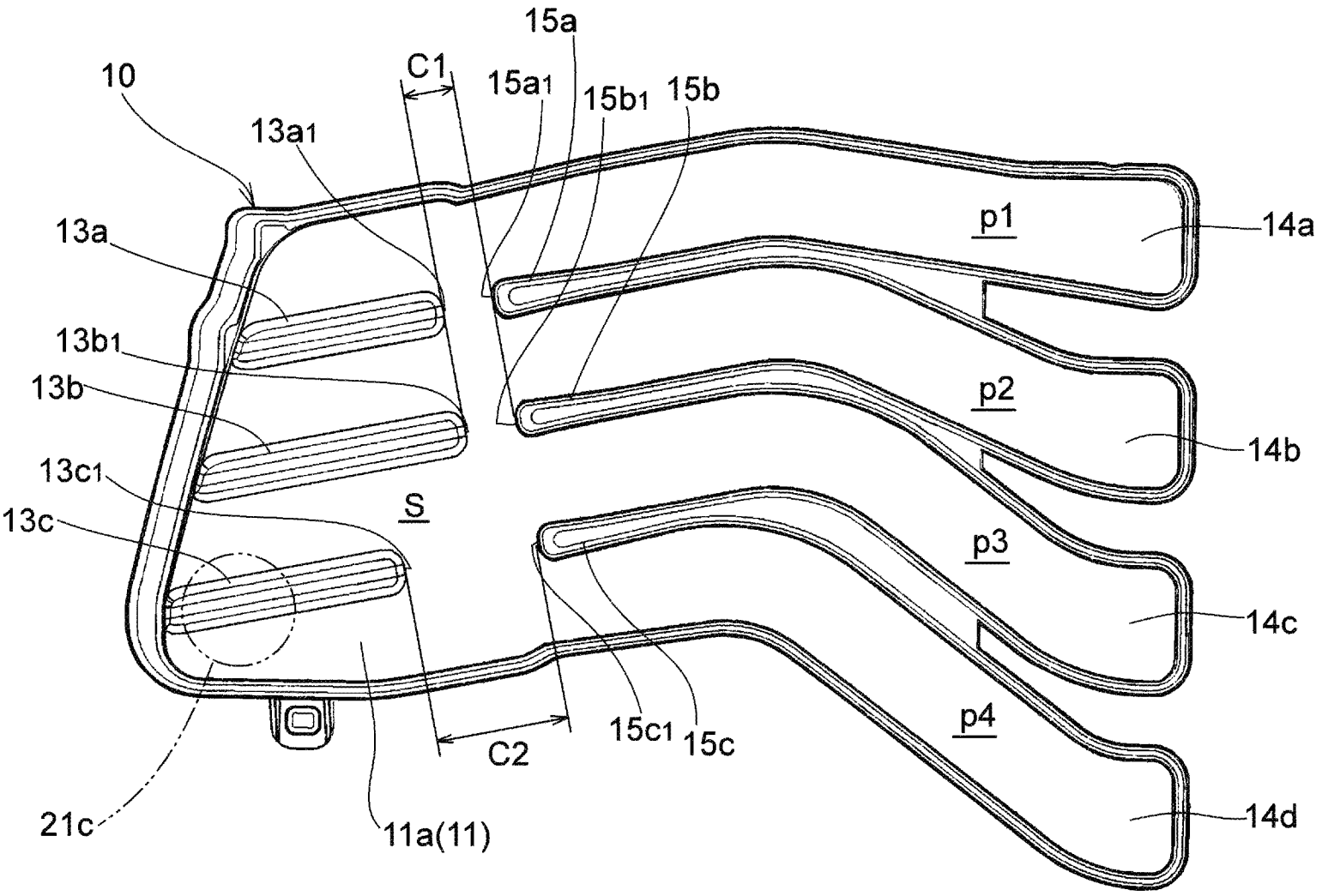
FIG. 8 is a view showing a relationship of a plurality of ridge portions and a plurality of branch walls provided in the surge tank of the intake manifold.

As shown in FIGS. 6 to 8, the inner wall surface 11*a* includes three ridge portions 13*a*, 13*b*, and 13*c* which protrude toward the internal space S.

Figure 5:
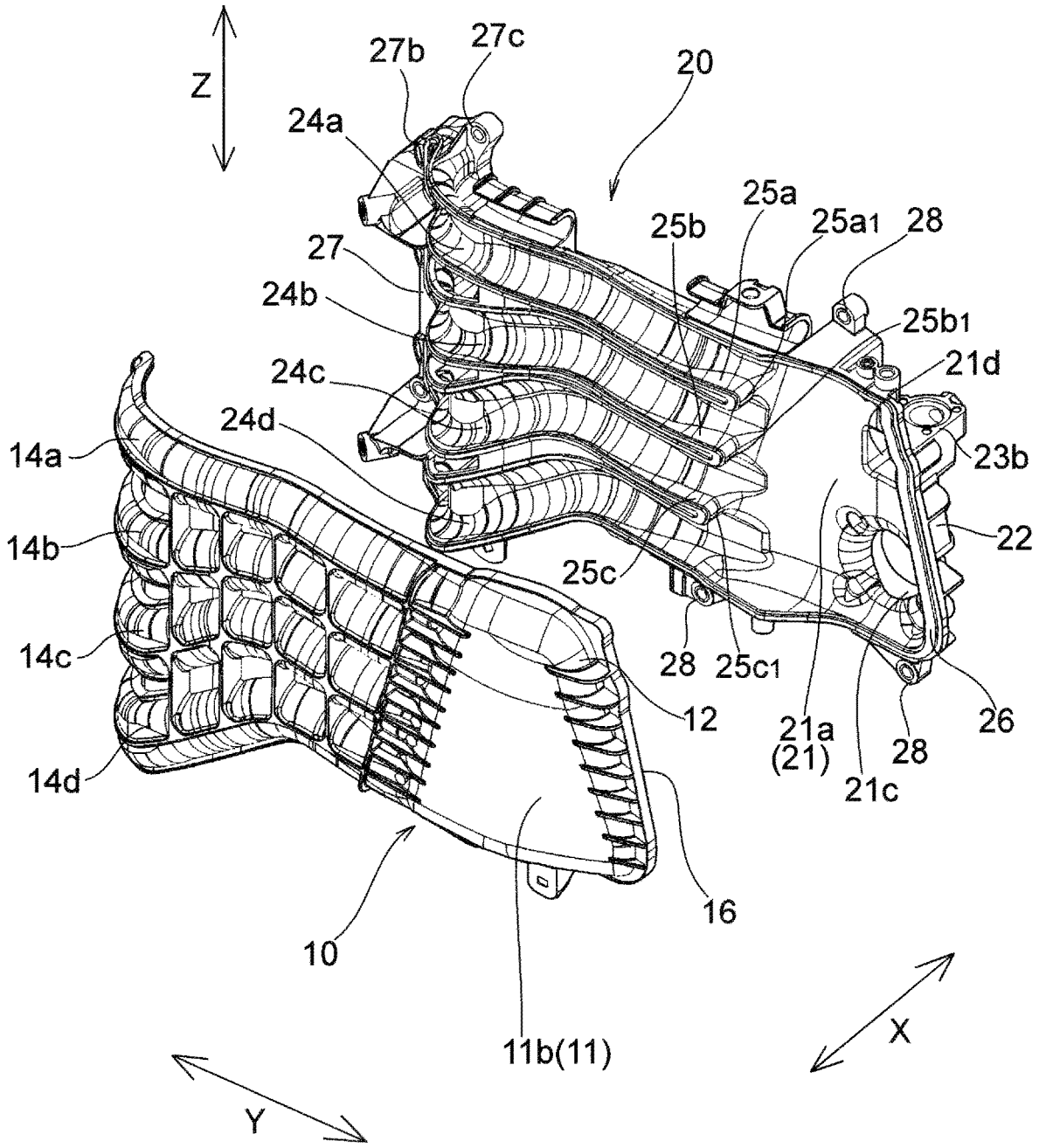
FIG. 5 is an exploded perspective view when a first resin molded body and a second resin molded body constituting the intake manifold of the disclosure are disassembled and viewed from the outside obliquely.

Since the outer wall surface 11*b* faces the engine cover 3 with a slight gap therebetween, the outer wall surface is formed to be flat without a reinforcing rib or the like as shown in FIGS. 3 and 5.

The outer peripheral wall 12 is bent from the outer edge area of the first extension wall 11 and is formed to connect and close the outer edge areas of the first extension wall 11 and the second extension wall 21 in cooperation with the outer peripheral wall 22.

As shown in FIGS. 6 to 9, the ridge portion 13*a* protrudes from the inner wall surface 11*a* of the first extension wall 11 toward the internal space S, is oriented toward the intake passages p1 and p2, and extends linearly toward the branch wall 15*a* to correspond to the branch wall 15*a*.

Further, a downstream end 13*a*1 of the ridge portion 13*a* and an upstream end 15*a*1 of the branch wall 15*a* are formed to face each other with a gap C1 therebetween in the extension direction of the ridge portion 13*a*.

As shown in FIGS. 6 to 9, the ridge portion 13*b* protrudes from the inner wall surface 11*a* of the first extension wall 11 toward the internal space S, is oriented toward the intake passages p2 and p3, and extends linearly toward the branch wall 15*b* to correspond to the branch wall 15*b*.

Further, a downstream end 13*b*1 of the ridge portion 13*b* and an upstream end 15*b*1 of the branch wall 15*b* are formed to face each other with the gap C1 therebetween in the extension direction of the ridge portion 13*b*.

As shown in FIGS. 6 to 9, the ridge portion 13*c* protrudes from the inner wall surface 11*a* of the first extension wall 11 toward the internal space S, is oriented toward the intake passages p3 and p4, and extends linearly toward the branch wall 15*c* to correspond to the branch wall 15*c*.

Further, a downstream end 13*c*1 of the ridge portion 13*c* and an upstream end 15*c*1 of the branch wall 15*c* are formed to face each other with a gap C2 therebetween in the extension direction of the ridge portion 13*c*.

Figure 9:
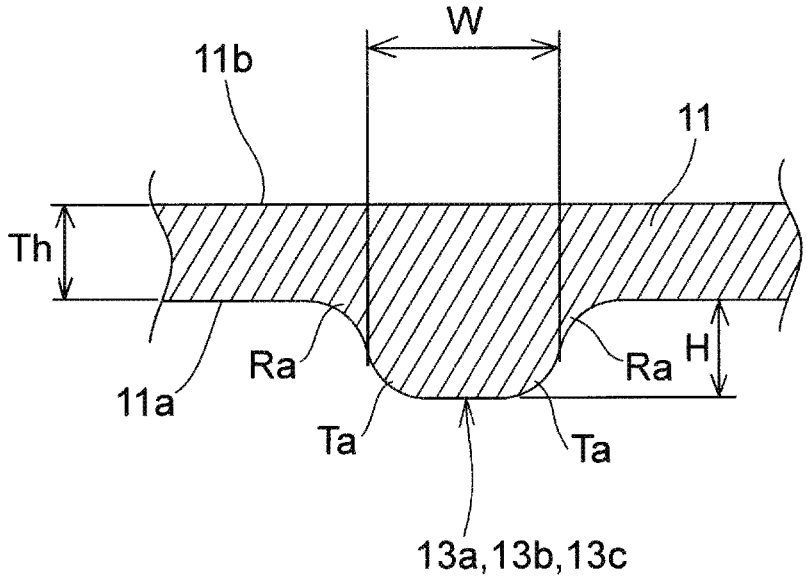
FIG. 9 is a partially cross-sectional view showing a cross-sectional shape of the plurality of ridge portions.

Here, three ridge portions 13*a*, 13*b*, and 13*c* are arranged to extend in parallel to each other and are formed to have a cross-section in which a root area Ra with the inner wall surface 11*a* is curved in a concave shape and a protruding tip area Ta is curved in a convex shape as shown in FIG. 9.

Specifically, when the plate thickness of the first extension wall 11 is indicated by Th, the ridge portions 13*a*, 13*b*, and 13*c* are formed in a cross-sectional shape in which a width dimension W is about twice (2 Th) the plate thickness and a protruding height H from the inner wall surface 11*a* is about the same (Th) as the plate thickness.

Further, the ridge portion 13*c* is a proximity ridge portion which is disposed in an area close to the intake inlet 21*c* provided in the second extension wall 21 facing the first extension wall 11.

Then, as shown in FIG. 8, the gap C2 between the upstream end 15*c*1 of the branch wall 15*c* and the downstream end 13*c*1 of the ridge portion 13*c* which is the proximity ridge portion is set to be larger than the gap C1 between the upstream ends 15*a*1 and 15*b*1 of the branch walls 15*a* and 15*b* and the downstream ends 13*a*1 and 13*b*1 of the other ridge portions 13*a* and 13*b* except for the ridge portion 13*c* among three ridge portions 13*a*, 13*b*, and 13*c*.

The passage wall 14*a* forms the branch pipe P1 defining the intake passage p1 in cooperation with the passage wall 24*a*.

The passage wall 14*b* forms the branch pipe P2 defining the intake passage p2 in cooperation with the passage wall 24*b*.

The passage wall 14*c* forms the branch pipe P3 defining the intake passage p3 in cooperation with the passage wall 24*c*.

The passage wall 14*d* forms the branch pipe P4 defining the intake passage p4 in cooperation with the passage wall 24*d*.

In the branch wall 15*a*, the upstream end 15*a*1 faces the internal space S and the branch wall branches the branch pipe P1 and the branch pipe P2 in cooperation with the branch wall 25*a*.

In the branch wall 15*b*, the upstream end 15*b*1 faces the internal space S and the branch wall branches the branch pipe P2 and the branch pipe P3 in cooperation with the branch wall 25*b*.

In the branch wall 15*c*, the upstream end 15*c*1 faces the internal space S and the branch wall branches the branch pipe P3 and the branch pipe P4 in cooperation with the branch wall 25*c*.

The first welded portion 16 is joined to the second welded portion 26 and vibration-welded to integrate the first resin molded body 10 and the second resin molded body 20.

The second extension wall 21 is formed to face the first extension wall 11 and includes an inner wall surface 21*a* defining the internal space S of the surge tank T and an outer wall surface 21*b* facing the engine body.

As shown in FIG. 5, the inner wall surface 21*a* is formed to be flat except for a concave portion 21*d* continuous with the flange portion 23*b* and the intake inlet 21*c*.

The outer wall surface 21*b* is provided with the flange portions 23*a* and 23*b* and a plurality of reinforcing ribs 23*c*.

The intake inlet 21*c* is disposed near the branch pipe P4 due to the arrangement in the engine body.

Thus, the lengths of the branch pipes P1 to P4 are appropriately set so that the lengths of four intake flow paths extending from the intake inlet 21*c* to four intake passages p1 to p4 through the internal space S are equal.

The outer peripheral wall 22 is bent from the outer edge area of the second extension wall 21 and is formed to connect and close the outer edge areas of the first extension wall 11 and the second extension wall 21 in cooperation with the outer peripheral wall 12.

The flange portion 23*a* is an area where the throttle body is joined and attached.

The flange portion 23*b* is an area where a valve unit for idle speed control is attached and is appropriately used in accordance with the engine specification.

The passage wall 24*a* forms the branch pipe P1 defining the intake passage p1 in cooperation with the passage wall 14*a*.

The passage wall 24*b* forms the branch pipe P2 defining the intake passage p2 in cooperation with the passage wall 14*b*.

The passage wall 24*c* forms the branch pipe P3 defining the intake passage p3 in cooperation with the passage wall 14*c*.

The passage wall 24*d* forms the branch pipe P4 defining the intake passage p4 in cooperation with the passage wall 14*d*.

In the branch wall 25*a*, an upstream end 25*a*1 faces the internal space S and the branch wall branches the branch pipe P1 and the branch pipe P2 in cooperation with the branch wall 15*a*.

In the branch wall 25*b*, an upstream end 25*b*1 faces the internal space S and the branch wall branches the branch pipe P2 and the branch pipe P3 in cooperation with the branch wall 15*b*.

In the branch wall 25*c*, an upstream end 25*c*1 faces the internal space S and the branch wall branches the branch pipe P3 and the branch pipe P4 in cooperation with the branch wall 15*c*.

The second welded portion 26 is joined to the first welded portion 16 and vibration-welded to integrate the first resin molded body 10 and the second resin molded body 20.

The flange portion 27 is used to attach the intake manifold M to the cylinder head of the engine body and includes four passages 27*a* which respectively communicate with four intake ports, four fitting holes 27*b* into which injectors Ij are respectively fitted, and a hole 27*c* through which a bolt to be screwed into the cylinder head passes.

A boss portion 28 is a portion through which the intake manifold M is fastened to the engine body using a screw.

In a method of manufacturing the intake manifold M, first, the first resin molded body 10 and the second resin molded body 20 are respectively injection-molded by dedicated molds.

Then, the first resin molded body 10 and the second resin molded body 20 are joined to each other and are vibration-welded while being pressurized so that the first welded portion 16 comes into contact with the second welded portion 26.

In this vibration-welding, the welding conditions are, for example, a vibration frequency of 200 Hz to 250 Hz and an amplitude in the range of 0.5 mm to 2.0 mm.

Next, a function of the intake manifold M including the plurality of ridge portions 13*a*, 13*b*, and 13*c* will be described with reference to FIGS. 7, 10, and 11.

Generally, when the cylinders corresponding to the branch pipes P1, P2, P3, and P4 in the in-line four-cylinder internal combustion engine are the first cylinder, the second cylinder, the third cylinder, and the fourth cylinder and the ignition order is, for example, 1-3-4-2, an intake flow is generated in order of the intake passage p1, the intake passage p3, the intake passage p4, and the intake passage p2 to correspond to the intake stroke of each cylinder.

The intake flow to the intake passages p1, p3, p4, and p2 will be schematically described under this precondition. As shown in FIG. 7, the intake air A introduced from the intake inlet 21*c* first flows to the internal space S to collide with the inner wall surface 11*a* of the first extension wall 11.

Figure 10:
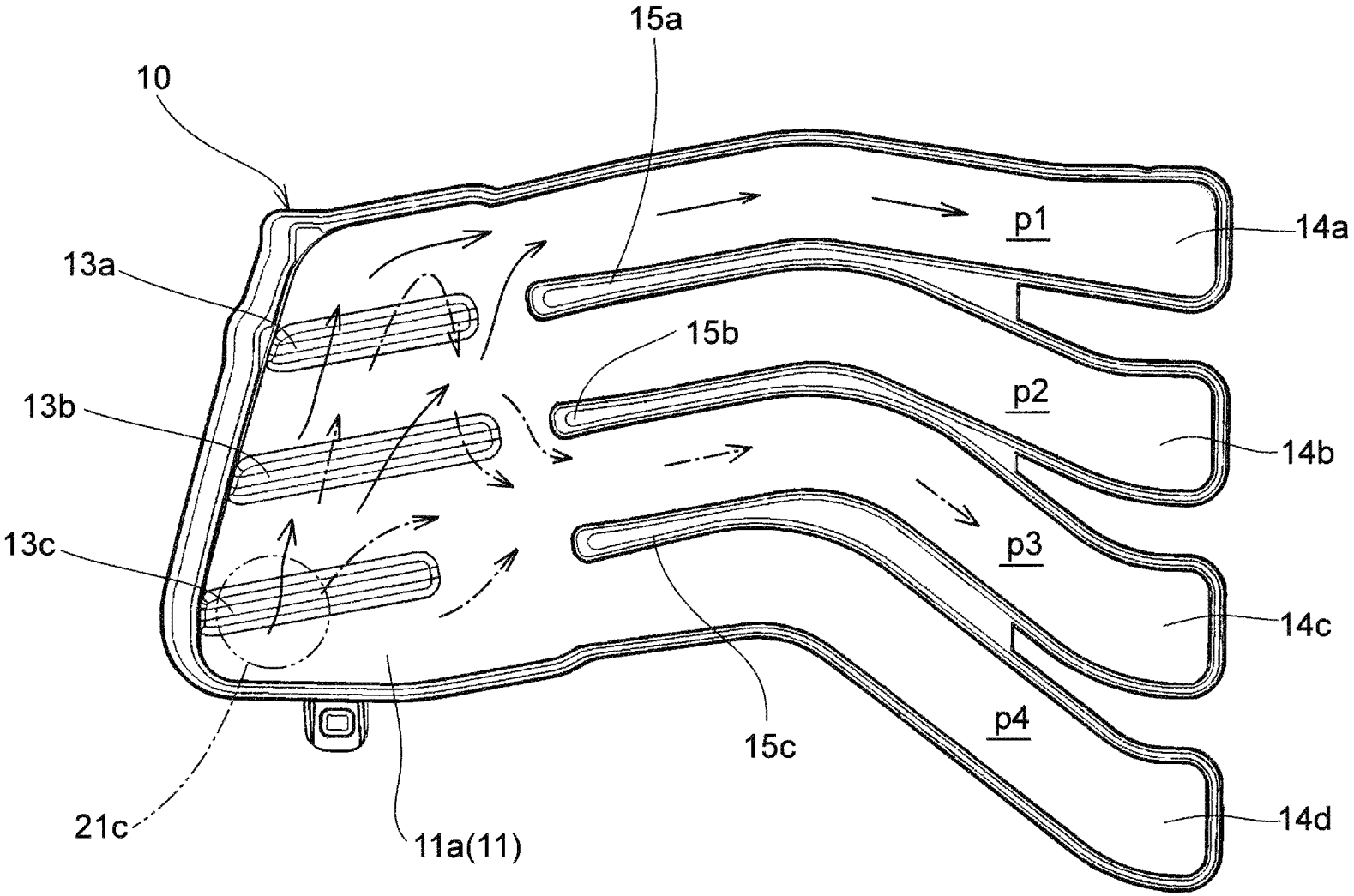
FIG. 10 is a schematic view showing a flow of an intake air from the side of an intake inlet 21*c* in a path from the surge tank to a branch pipe.

Then, when the first cylinder is in the intake stroke, as indicated by the solid arrow of FIG. 10, the intake air flows across the ridge portion 13*b* and the ridge portion 13*a*, then flows into the intake passage p1, flows across the ridge portion 13*b*, comes out from the gap C1 between the ridge portion 13*a* and the branch wall 15*a* (25*a*), and then flows into the intake passage p1.

Next, when the third cylinder is in the intake stroke, as indicated by the one-dotted chain line of FIG. 10, the intake air flows into the intake passage p3 along the ridge portions 13*c* and 13*b*, is turned back after heading toward the ridge portion 13*c*, comes out from the gap C2 between the ridge portion 13*c* and the branch wall 15*c* (25*c*), then flows into the intake passage p3, is turned back after heading toward the ridge portions 13*b* and 13*a*, flows across the ridge portion 13*b*, flows into the intake passage p3 or comes out from the gap C1 between the ridge portion 13*b* and the branch wall 15*b* (25*b*), and then flows through the intake passage p3.

Figure 11:
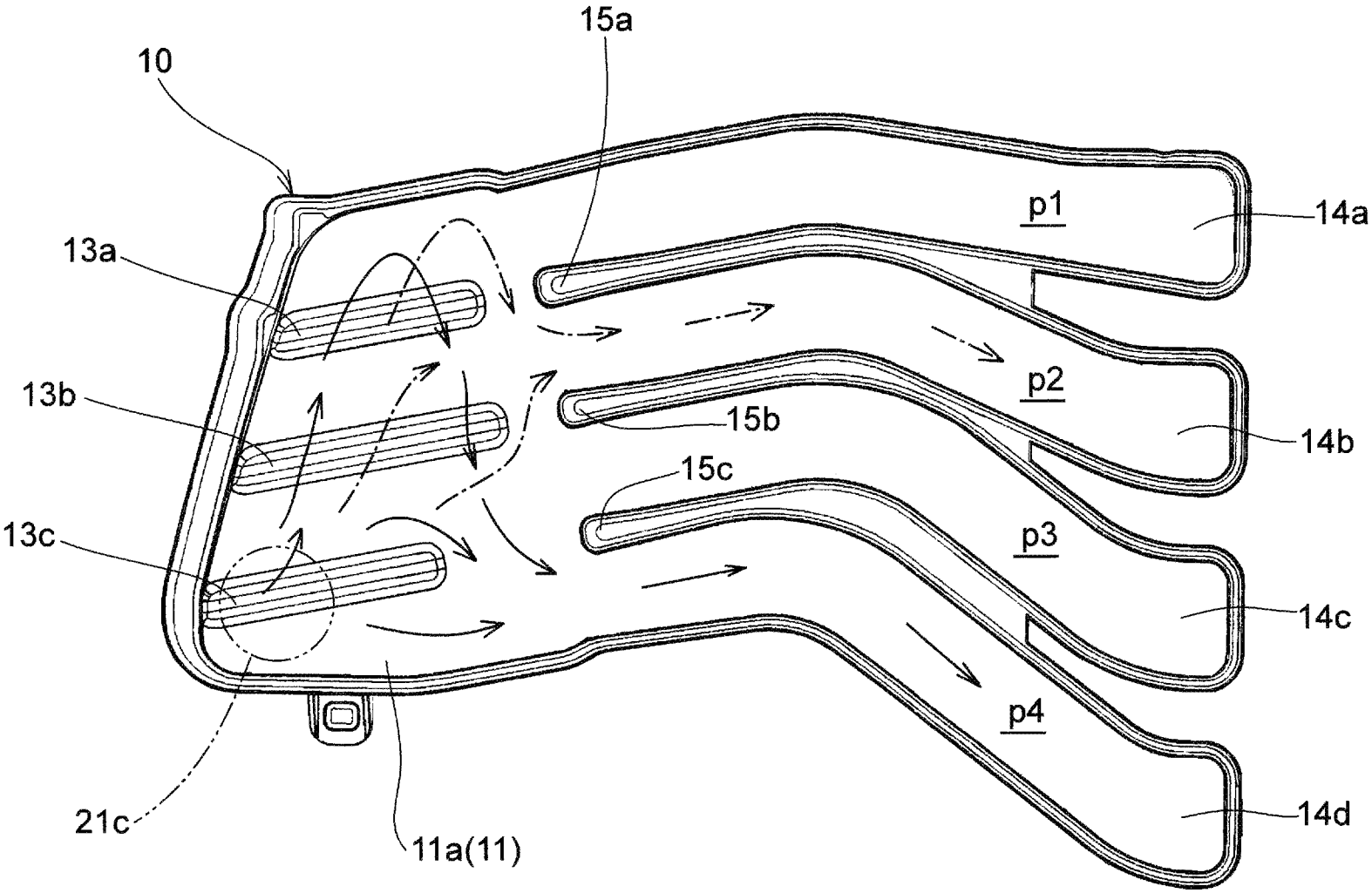
FIG. 11 is a schematic view showing a flow of an intake air from the side of the intake inlet 21*c* in the path from the surge tank to the branch pipe.

Next, when the fourth cylinder is in the intake stroke, as indicated by the solid line of FIG. 11, the intake air flows into the intake passage p4 along the ridge portion 13*c*, is turned back after heading toward the ridge portions 13*b* and 13*a*, comes out from the gap C2 between the ridge portion 13*c* and the branch wall 15*c* (25*c*), and then flows into the intake passage p4.

Next, when the second cylinder is in the intake stroke, as indicated by the one-dotted chain line of FIG. 11, the intake air flows across the ridge portion 13*b*, then flows into the intake passage p2, is turned back after heading toward the ridge portions 13*b* and 13*a*, comes out from the gap C1 between the ridge portion 13*a* and the branch wall 15*a* (25*a*), then flows into the intake passage p2, flows along the ridge portions 13*c* and 13*b*, comes out from the gap C1 between the ridge portion 13*b* and the branch wall 15*b* (25*b*), and then flows into the intake passage p2.

In this way, the intake air flows into the internal space S and then flows toward the intake passages p1, p3, p4, and p2 corresponding to the cylinder performing the intake stroke while receiving rectification action by the plurality of ridge portions 13*a*, 13*b*, and 13*c* without stagnation.

In the intake manifold M, since the plurality of ridge portions 13*a*, 13*b*, and 13*c* which protrudes from the inner wall surface 11*a* of the first extension wall 11 toward the internal space S is provided, it is possible to improve the pressure resistance strength and the mechanical strength even when the surge tank T is formed to be flat. Further, since the outer wall surface 11*b* of the first extension wall 11 is formed to be flat, the surge tank can be disposed to be adjacent to the engine cover 3 when the intake manifold is mounted on the outboard motor. Therefore, the outboard motor can be made smaller and thinner in the width direction (the horizontal direction X).

Further, since the plurality of ridge portions 13*a*, 13*b*, and 13*c* is oriented toward the intake passages p1, p2, p3, and p4, the intake air having flowed from the intake inlet 21*c* into the internal space S can be rectified to be guided toward the intake passages p1, p2, p3, and p4, the flow stagnation can be suppressed and prevented, the flow loss, the passage resistance, and the pressure loss of the intake air can be reduced, the intake resistance in the plurality of intake passages p1, p2, p3, and p4 is also smoothed, and the filling efficiency of the intake air in the combustion chamber can be improved.

In the intake manifold M, since the ridge portions 13*a*, 13*b*, and 13*c* are formed to have a cross-section in which the root area Ra with the inner wall surface 11*a* is curved in a concave shape and the protruding tip area Ta is curved in a convex shape, the flow separation phenomenon can be suppressed and prevented, the flow loss, the passage resistance, and the pressure loss of the intake air can be reduced, and the filling efficiency of the intake air in the combustion chamber can be improved when the intake air flows across the ridge portions 13*a*, 13*b*, and 13*c*.

Further, since the plurality of ridge portions 13, 13*b*, and 13*c* and the plurality of branch walls 15*a*, 15*b*, and 15*c* are formed to face each other with the predetermined gaps C1 and C2 therebetween, it is possible to promote the flow of the intake air toward the intake passages p1, p3, p4, and p2 in order corresponding to the intake stroke in the vicinity of the branch walls 15*a*, 15*b*, and 15*c*.

Further, since the gap C2 between the proximity ridge portion (the ridge portion 13*c*) disposed in an area close to the intake inlet 21*c* and the branch wall 15*c* is set to be larger than the gap C1 between the other ridge portions 13*a* and 13*b* and the branch walls 15*a* and 15*b*, the intake air that has turned back after heading toward the other ridge portions 13*a* and 13*b* can be guided from the vicinity of the branch wall 15*c* toward the intake passage p3 or the intake passage p4 corresponding to the intake stroke.

Figure 12:
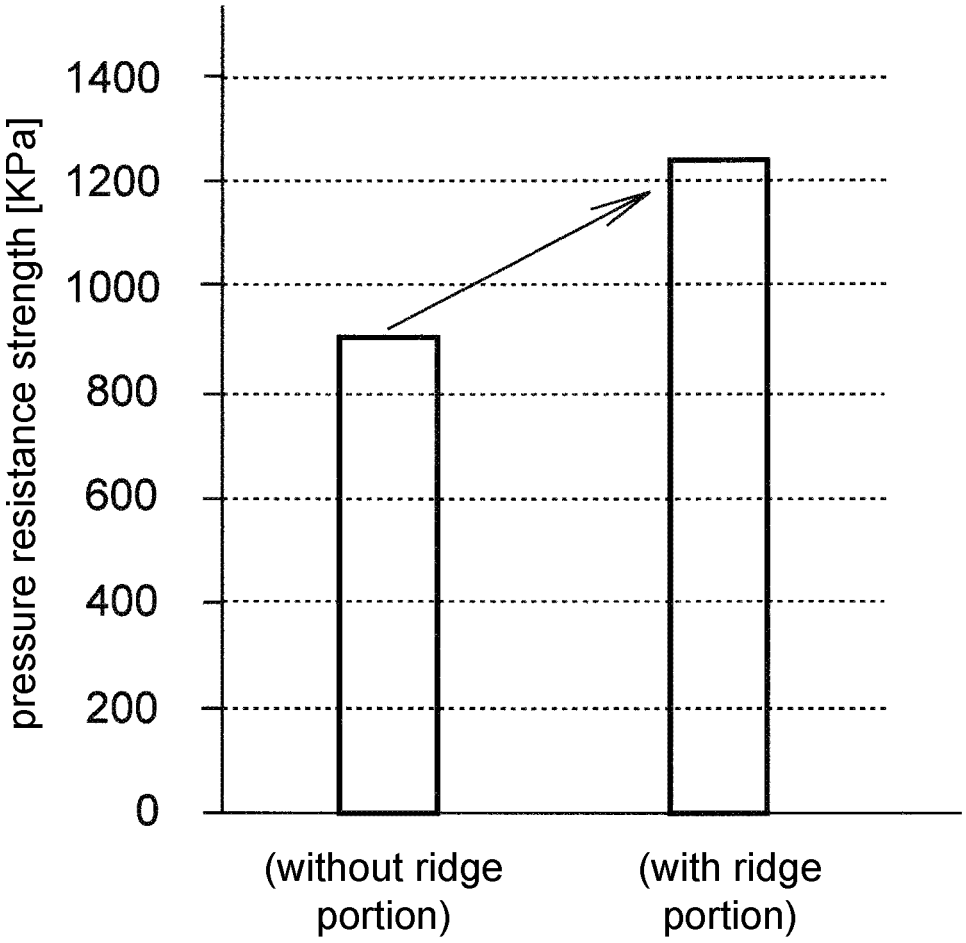
FIG. 12 is a graph showing a difference in pressure resistance strength between the configuration of the disclosure in which the plurality of ridge portions is provided in the surge tank and the configuration in which the plurality of ridge portions is not provided in the surge tank.

As described above, since the plurality of ridge portions 13*a*, 13*b*, and 13*c* is provided in the inner wall surface 11*a* of the first extension wall 11 which is the contour wall of the surge tank T forming a flat contour, the pressure resistance strength and the mechanical strength can be improved compared to a case in which there is no ridge portion as shown in FIG. 12.

Figure 13:
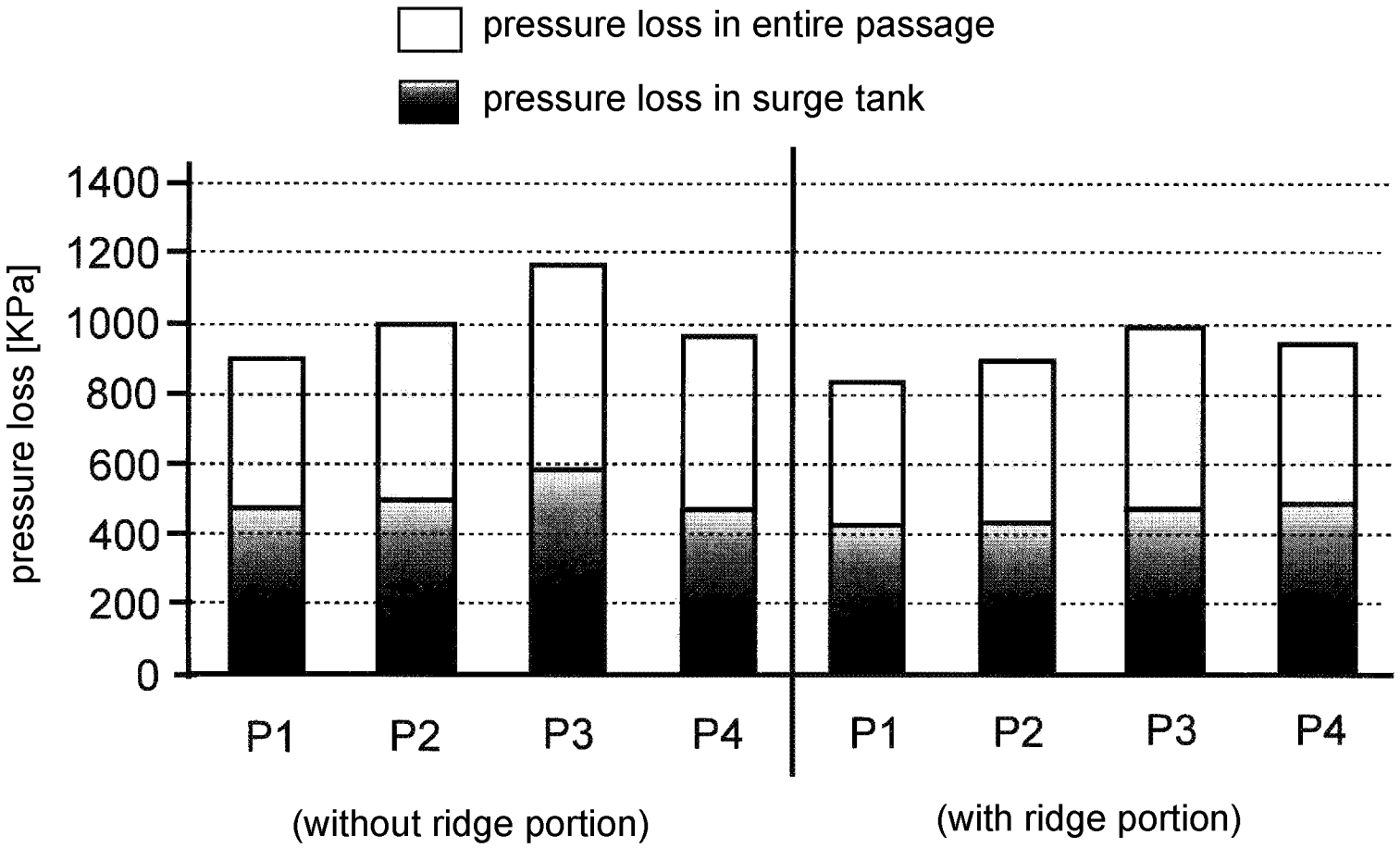
FIG. 13 is a graph showing a difference in pressure loss (passage resistance) between the configuration of the disclosure in which the plurality of ridge portions is provided in the surge tank and the configuration in which the plurality of ridge portions is not provided in the surge tank.

Further, when there is no ridge portion as shown in FIG. 13, the pressure loss in the surge tank T particularly in the vicinity of the branch pipe P3 is large and the pressure loss in the entire passage is also high. However, when the plurality of ridge portions 13*a*, 13*b*, and 13*c* is provided, the pressure loss in the surge tank T in the vicinity of the plurality of branch pipes P1, P2, P3, and P4 is smoothed, the intake resistance in the plurality of intake passages p1, p2, p3, and p4 is also smoothed by the rectifying action, and the pressure loss in the entire passage can also be reduced. In this way, since the pressure loss, that is, the passage resistance, is reduced, it is possible to improve the filling efficiency of the intake air in the combustion chamber.

Figure 14:
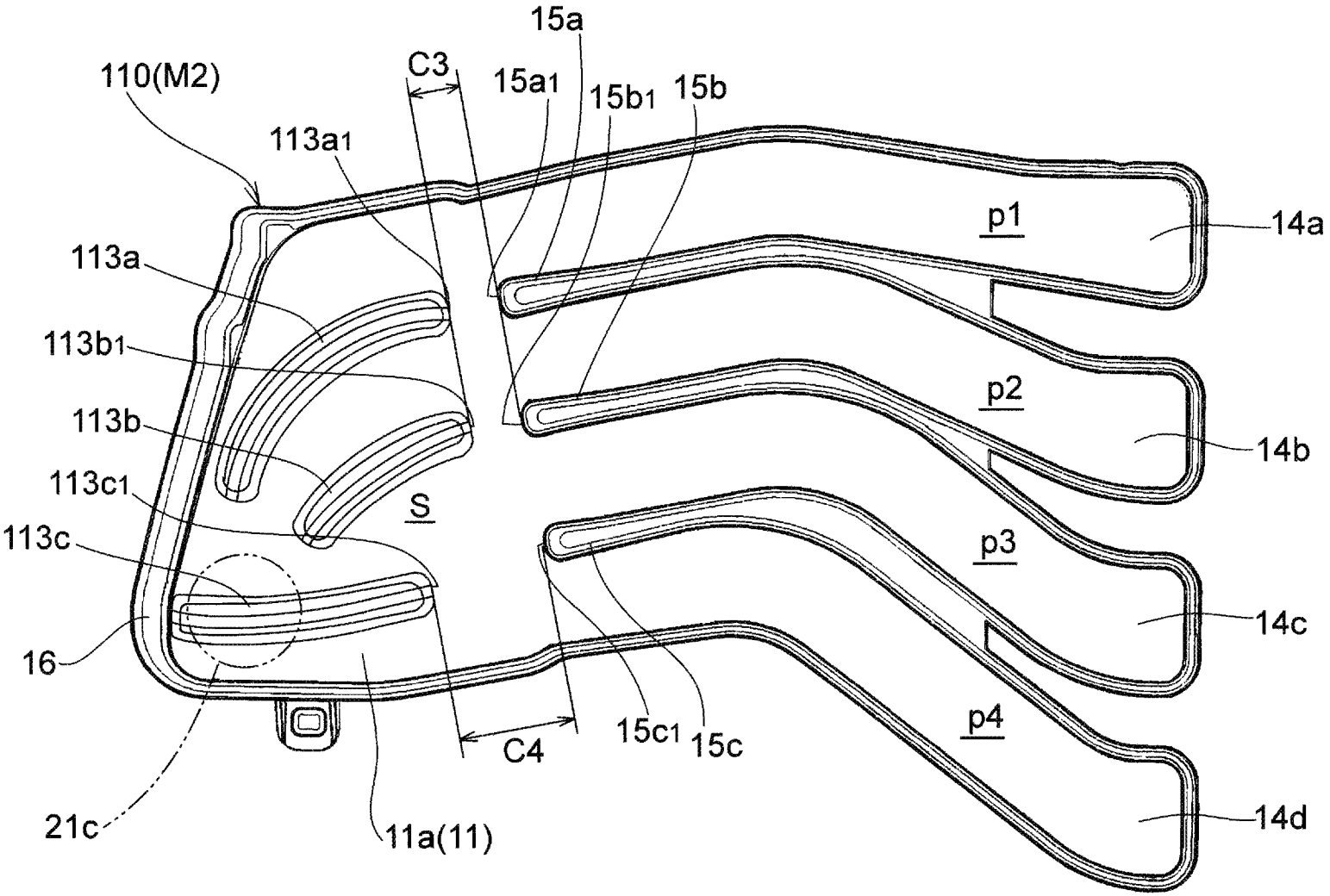
FIG. 14 is a view showing another embodiment of the plurality of ridge portions provided in the surge tank of the intake manifold.

FIG. 14 shows another embodiment of the intake manifold and this embodiment is the same as the above-described embodiment except that a plurality of ridge portions 113*a*, 113*b*, and 113*c* is adopted instead of the plurality of ridge portions 13*a*, 13*b*, and 13*c*. Therefore, the same configurations as those in the above-described embodiment are designated by the same reference numerals and the description thereof will be omitted.

An intake manifold M2 according to this embodiment is formed by integrally joining a first resin molded body 110 and the second resin molded body 20 by vibration-welding.

The first resin molded body 110 is previously molded by a mold using a thermoplastic resin material and includes the first extension wall 11 and the outer peripheral wall 12 which are contour walls, a plurality of (here, three) ridge portions 113*a*, 113*b*, and 113*c* which is provided in the inner wall surface 11*a* of the first extension wall 11, four passage walls 14*a*, 14*b*, 14*c*, and 14*d* which define half bodies of the branch pipes P1 to P4, a plurality of (here, three) branch walls 15*a*, 15*b*, and 15*c* which respectively extends from the branch points of four passage walls 14*a* to 14*d*, and the first welded portion 16 which has an annular shape.

The ridge portion 113*a* protrudes from the inner wall surface 11*a* of the first extension wall 11 toward the internal space S, is oriented toward the intake passages p1 and p2, and extends as being curved streamlinely from the intake inlet 21*c* toward the branch wall 15*a* to correspond to the branch wall 15*a*. Further, a downstream end 113*a*1 of the ridge portion 113*a* and the upstream end 15*a*1 of the branch wall 15*a* are formed to face each other with a gap C3 therebetwen in the extension direction of the ridge portion 113*a*.

The ridge portion 113*b* protrudes from the inner wall surface 11*a* of the first extension wall 11 toward the internal space S, is oriented toward the intake passages p2 and p3, and extends as being curved streamlinely from the intake inlet 21*c* toward the branch wall 15*b* to correspond to the branch wall 15*b*.

Further, a downstream end 113*b*1 of the ridge portion 113*b* and the upstream end 15*b*1 of the branch wall 15*b* are formed to face each other with the gap C3 therebetween in the extension direction of the ridge portion 113*b*.

The ridge portion 113*c* protrudes from the inner wall surface 11*a* of the first extension wall 11 toward the internal space S, is oriented toward the intake passages p3 and p4, and extends as being curved streamlinely from the intake inlet 21*c* toward the branch wall 15*c* to correspond to the branch wall 15*c*.

Further, a downstream end 113*c*1 of the ridge portion 113*c* and the upstream end 15*c*1 of the branch wall 15*c* are formed to face each other with a gap C4 therebetween in the extension direction of the ridge portion 113*c*.

Here, as shown in FIG. 9, three ridge portions 113*a*, 113*b*, and 113*c* are formed to have a cross-section in which the root area Ra with the inner wall surface 11*a* is curved in a concave shape and the protruding tip area Ta is curved in a convex shape.

Specifically, when the plate thickness of the first extension wall 11 is indicated by Th, the ridge portions 113*a*, 113*b*, and 113*c* are formed in a cross-section shape in which a width dimension W is about twice (2 Th) the plate thickness and a protruding height H from the inner wall surface 11*a* is about the same (Th) as the plate thickness.

Further, the ridge portion 113*c* is a proximity ridge portion which is disposed in an area close to the intake inlet 21*c* provided in the second extension wall 21 facing the first extension wall 11.

Then, as shown in FIG. 14, the gap C4 between the upstream end 15*c*1 of the branch wall 15*c* and the downstream end 113*c*1 of the ridge portion 113*c* which is the proximity ridge portion is set to be larger than the gap C3 between the upstream ends 15*a*1 and 15*b*1 of the branch walls 15*a* and 15*b* and the downstream ends 113*a*1 and 113*b*1 of the other ridge portions 113*a* and 113*b* except for the ridge portion 113*c* among three ridge portions 113*a*, 113*b*, and 113*c*.

In the intake manifold M2, since the plurality of ridge portions 113*a*, 113*b*, and 113*c* which protrudes from the inner wall surface 11*a* of the first extension wall 11 toward the internal space S is provided, the pressure resistance strength and the mechanical strength can be improved and the outboard motor can be made smaller and thinner in the width direction (the horizontal direction X) similarly to the above-described embodiment.

Further, the flow loss, the passage resistance, and the pressure loss of the intake air can be reduced, the intake resistance of the plurality of intake passages p1, p2, p3, and p4 is also smoothed, and the filling efficiency of the intake air in the combustion chamber can be improved.

Figure 15:
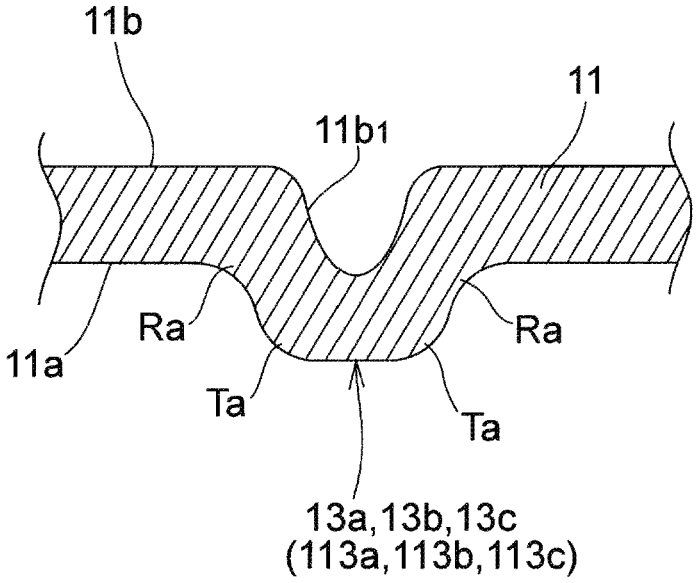
FIG. 15 is a partially cross-sectional view showing another cross-sectional embodiment of the plurality of ridge portions.

FIG. 15 shows still another embodiment of the intake manifold in which the shape of the outer wall surface 11*b* of the first extension wall 11 which is the contour wall provided with the plurality of ridge portions is changed.

That is, the outer wall surface 11*b* of the first extension wall 11 provided with the ridge portions 13, 13*b*, and 13*c* (113*a*, 11*b*, and 113*c*) is formed to include a grooved recess 11*b*1 which is recessed inward in a groove shape.

According to this embodiment, the plate thickness of the contour wall defining the surge tank T can be made uniform on the whole, the flow of the molding resin material is made uniform, and the moldability when molding with a mold can be improved while maintaining the mechanical strength.

In the above-described embodiment, a case in which three ridge portions 13*a*, 13*b*, and 13*c* (113*a*, 113*b*, and 113*c*) are provided as the plurality of ridge portions is shown, but the disclosure is not limited thereto. If necessary, the number of the ridge portions can be changed.

Further, in the above-described embodiment, a case in which the ridge portions 13*a*, 13*b*, and 13*c* extending linearly or the ridge portions 113*a*, 113*b*, and 113*c* extending in a curved state are adopted as the form of the ridge portion is shown, but the disclosure is not limited thereto. As long as it is oriented toward the intake passage side, other forms of ridge portions may be adopted.

In the above-described embodiment, a case in which the ridge portions 13*a*, 13*b*, and 13*c* (113*a*, 113*b*, and 113*c*) having a cross-section in which the root area Ra with the inner wall surface 11*a* of the contour wall is curved in a concave shape and the protruding tip area Ta is curved in a convex shape are adopted as the ridge portions is shown, but the disclosure is not limited thereto. A ridge portion having another cross-sectional shape may be adopted as long as it does not disturb the flow of the intake air and does not impair the function of the surge tank T.

In the above-described embodiment, the intake manifolds M and M2 obtained by vibration-welding the first resin molded bodies 10 and 110 and the second resin molded body 20 are shown, but the disclosure is not limited thereto. If necessary, three or more resin molded bodies may be vibration-welded.

As described above, according to the intake manifold of the disclosure, since it is possible to ensure a pressure resistance strength, a mechanical strength, and the like while making the intake manifold smaller and thinner and to also reduce a passage resistance, the intake manifold can be applied to the engine of the outboard motor and is also useful as intake manifolds for other engines.

What is claimed is:

1. An intake manifold made of a resin and configured to be applied to an engine, comprising:

a surge tank which forms a flat contour and includes an intake inlet;

a plurality of branch pipes which defines an intake passage communicating with an internal space of the surge tank; and a plurality of branch walls which branches the plurality of branch pipes from the surge tank, wherein a contour wall of the surge tank includes a plurality of ridge portions which protrudes toward the internal space and is oriented toward the intake passage, wherein the plurality of branch walls are separated from the plurality of ridge portions.

2. The intake manifold according to claim 1, wherein the plurality of ridge portions has a cross-section in which a root area with an inner wall surface of the contour wall is curved in a concave shape and a protruding tip area is curved in a convex shape.

3. The intake manifold according to claim 1, wherein the contour wall of the surge tank includes a first extension wall which extends along a plane direction in which the plurality of branch pipes is arranged, a second extension wall which faces the first extension wall, and an outer peripheral wall which connects and closes outer edge areas of the first extension wall and the second extension wall, wherein the first extension wall is provided with the plurality of ridge portions, and wherein the second extension wall is provided with the intake inlet.

4. The intake manifold according to claim 1, wherein the plurality of ridge portions is arranged to respectively correspond to the plurality of branch walls.

5. The intake manifold according to claim 4, wherein the plurality of ridge portions respectively face the plurality of branch walls, and each of the plurality of ridge portions and a corresponding one of the plurality of branch walls have a predetermined gap therebetween.

6. The intake manifold according to claim 5, wherein the plurality of ridge portions includes a proximity ridge portion which is disposed in an area close to the intake inlet, and wherein the gap between the proximity ridge portion and a corresponding one of the plurality of branch walls is set to be larger than the gap between the other one of the plurality of ridge portions and a corresponding one of the plurality of branch walls.

7. The intake manifold according to claim 4, wherein the ridge portions are formed to extend linearly toward the branch walls, correspondingly.

8. The intake manifold according to claim 4, wherein the ridge portions are formed to extend as being curved streamlinely from the intake inlet toward the branch walls, correspondingly.

9. The intake manifold according to claim 1, wherein an outer wall surface of the contour wall provided with the plurality of ridge portions is formed to be flat.

10. The intake manifold according to claim 1, wherein an outer wall surface of the contour wall provided with the plurality of ridge portions is formed to be recessed in a groove shape.

11. The intake manifold according to claim 1, wherein the intake manifold is formed by vibration-welding a first resin molded body defining a half body of the surge tank and half bodies of the branch pipes and a second resin molded body defining a half body of the surge tank and half bodies of the branch pipes.

12. The intake manifold according to claim 11, wherein the first resin molded body includes a first extension wall which extends along a plane direction in which the plurality of branch pipes is arranged, the plurality of ridge portions which are provided in the first extension wall, and a first welded portion which has an annular shape, and wherein the second resin molded body includes a second extension wall which faces the first extension wall, the intake inlet which is provided in the second extension wall, and a second welded portion which is welded to the first welded portion and has an annular shape.

13. An outboard motor comprising:

an engine which includes an intake manifold;

a body which holds the engine;

a propeller which is rotated by driving power of the engine; and an engine cover which covers the engine, wherein the intake manifold is the intake manifold according to claim 1.

* * * * *